US010994814B1

(12) United States Patent
Hart

(10) Patent No.: US 10,994,814 B1
(45) Date of Patent: May 4, 2021

(54) RETROFITTABLE SEAT ASSEMBLY

(71) Applicant: Jeffrey K. Hart, Lake Tapps, WA (US)

(72) Inventor: Jeffrey K. Hart, Lake Tapps, WA (US)

( * ) Notice: Subject to any disclaimer, the term of this patent is extended or adjusted under 35 U.S.C. 154(b) by 0 days.

(21) Appl. No.: 16/390,781

(22) Filed: Apr. 22, 2019

Related U.S. Application Data

(60) Provisional application No. 62/800,725, filed on Feb. 4, 2019.

(51) Int. Cl.
*B63B 29/04* (2006.01)
*B63B 32/00* (2020.01)
*B63B 32/70* (2020.01)

(52) U.S. Cl.
CPC ..... *B63B 29/04* (2013.01); *B63B 32/00* (2020.02); *B63B 32/70* (2020.02); *B63B 2029/043* (2013.01)

(58) Field of Classification Search
CPC ..... B63B 29/04; B63B 29/06; B63B 32/70; B63B 32/00; B63B 2029/043
See application file for complete search history.

(56) References Cited

U.S. PATENT DOCUMENTS 3,603,547 A * 9/1971 Hills ..... A63G 9/00 248/188.2
4,319,729 A * 3/1982 Lo ..... A47C 7/004 211/203
4,752,261 A * 6/1988 Rosello Zoya ..... B63B 32/56 441/74
4,898,113 A * 2/1990 Tapley ..... B63B 32/60 114/283
6,062,638 A 5/2000 Ferguson
7,396,083 B2 7/2008 Kasner
9,027,501 B2 5/2015 Wood et al.
9,290,245 B2 3/2016 Bishop
9,643,696 B1 5/2017 Lockhart et al.
10,173,756 B2 * 1/2019 Little ..... B63B 32/70
2011/0088610 A1 * 4/2011 Wood ..... B63B 29/04 114/363
2015/0059637 A1 * 3/2015 Johns ..... B63B 34/20 114/363
2018/0065718 A1 * 3/2018 Isom ..... B63B 32/70
2018/0334227 A1 * 11/2018 Mellina ..... B63B 32/70
2018/0362122 A1 * 12/2018 Duff ..... B63B 32/45
2019/0092434 A1 * 3/2019 Mellina ..... B63B 32/00

FOREIGN PATENT DOCUMENTS

AU 2013100826 A4 7/2013
EP 0124675 A1 11/1984

OTHER PUBLICATIONS

Hala Gear; Hala Kayak Seat for Stand Up Paddle Boards, https://halagear.com/product/hala-kayak-seat/; accessed Oct. 23, 2018; 4 pages.

(Continued)

*Primary Examiner* — Philip F Gabler
(74) *Attorney, Agent, or Firm* — Dicke, Billig & Czaja, PLLC

(57) ABSTRACT

A retrofittable seat assembly comprises a base, a base receiver operatively connected to the base and configured and arranged to receive a mounting post of a seat, and a connecting member configured and arranged to connect the base to a support structure.

20 Claims, 12 Drawing Sheets

(56) References Cited

OTHER PUBLICATIONS

Supseat; The Supseat System; http://supseat.com/technology.html; accessed Oct. 23, 2018; 2 pages.
Ventureglide; https://youtu.be/uVMIQIsT8PU; published Nov. 7, 2014; accessed Apr. 22, 2019; This is a video, please visit the web address to view the video.
Beach Craft Products, Inc; "VentureGlide SUP Breakthrough"; YouTube video posted Nov. 7, 2014; retrieved Aug. 13, 2020 at https://www.youtube.com/watch?v=uVMIQIsT8PU&feature=youtu.be; 1 page.
Saturn Inflatable Boats; "Test of new invention protoype—bike seat for SUP paddle board"; YouTube video posted Jan. 28, 2014; retrieved Aug. 13, 2020 at https://www.youtube.com/watch?v=sv9ih6vJ838&feature=youtu.be; 1 page.

* cited by examiner

RETROFITTABLE SEAT ASSEMBLY

BACKGROUND

Standup paddle boards provide users with a great way to exercise because they require balance while standing, sitting, or lying on the boards during use. A user could become exhausted from paddling and want to rest, and it could be difficult to move between or among positions on the board. Therefore, there is a need for a seat assembly that is easy to use.

Many people buy or rent boards, and some people may want to use a variety of boards. Therefore, there is a need for a retrofittable seat assembly that is easily connected to a variety of boards or other support structures.

For the reasons stated above and for other reasons stated below, which will become apparent to those skilled in the art upon reading and understanding the present specification, a need exists for the present invention.

SUMMARY

The above-mentioned problems associated with prior devices are addressed by embodiments of the disclosure and will be understood by reading and understanding the present specification. The following summary is made by way of example and not by way of limitation.

In one embodiment, a retrofittable seat assembly comprises a base, a base receiver operatively connected to the base and configured and arranged to receive a mounting post of a seat, and a connecting member configured and arranged to connect the base to a support structure.

In one embodiment, a retrofittable seat assembly comprises a base, a connecting member configured and arranged to connect the base to a support structure, a base receiver operatively connected to the base and configured and arranged to receive a mounting post of a seat, and at least one support interconnecting the base and the base receiver. The at least one support includes a void configured and arranged to receive a portion of the connecting member.

In one embodiment method of connecting a retrofittable seat assembly to a support structure, a base is placed on the support structure, an elongate member is positioned about portions of the base and the support structure, the elongate member is secured, and a seat is connected to the base.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. In accordance with common practice, the various described features are not drawn to scale but are drawn to emphasize specific features relevant to the present disclosure. Reference characters denote like elements throughout the Figures and the text.

DETAILED DESCRIPTION

In the following detailed description, reference is made to the accompanying drawings, which form a part hereof, and in which is shown by way of illustration embodiments in which the disclosure may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that other embodiments may be utilized and mechanical changes may be made without departing from the spirit and scope of the present disclosure. The following detailed description is, therefore, not to be taken in a limiting sense.

Embodiments of the disclosure provide a retrofittable seat assembly for use with a variety of support structures.

Figure 1:
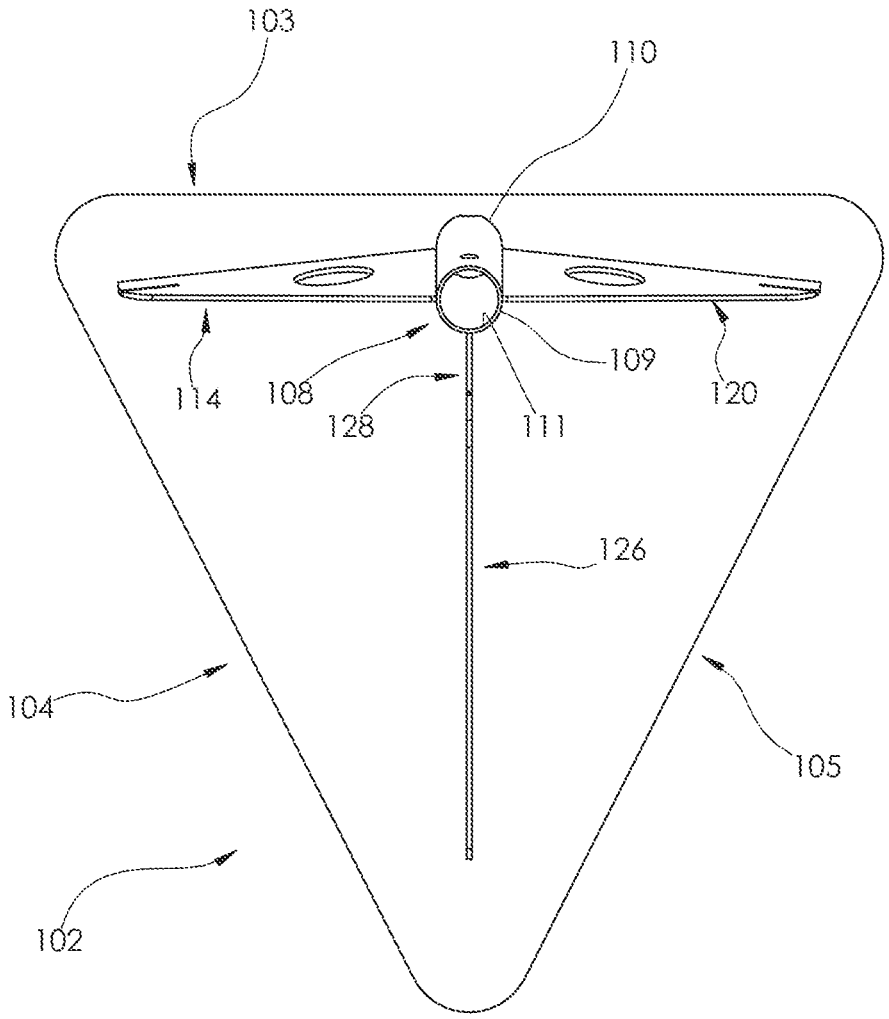
FIG. 1 is a top view of a base of an embodiment retrofittable seat assembly.
Figure 2:
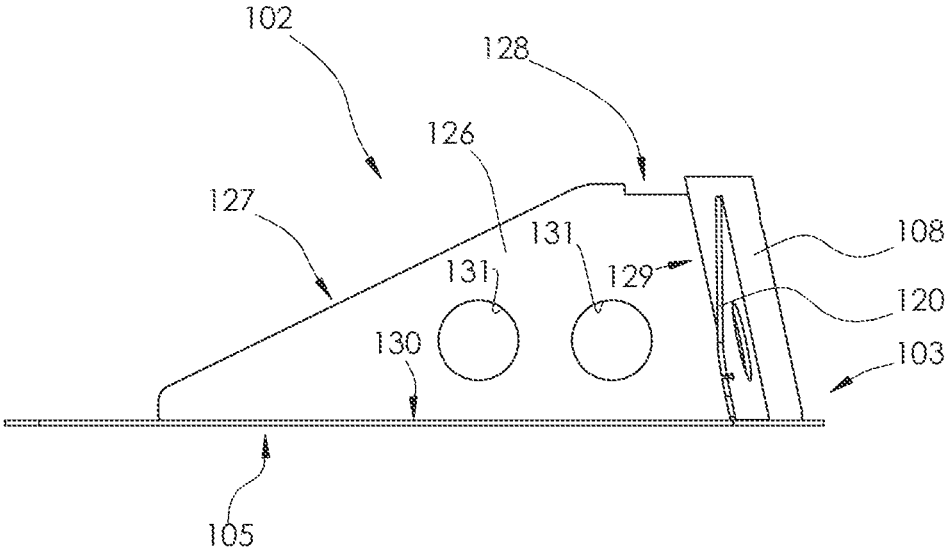
FIG. 2 is a side view of the base shown in FIG. 1.
Figure 3:
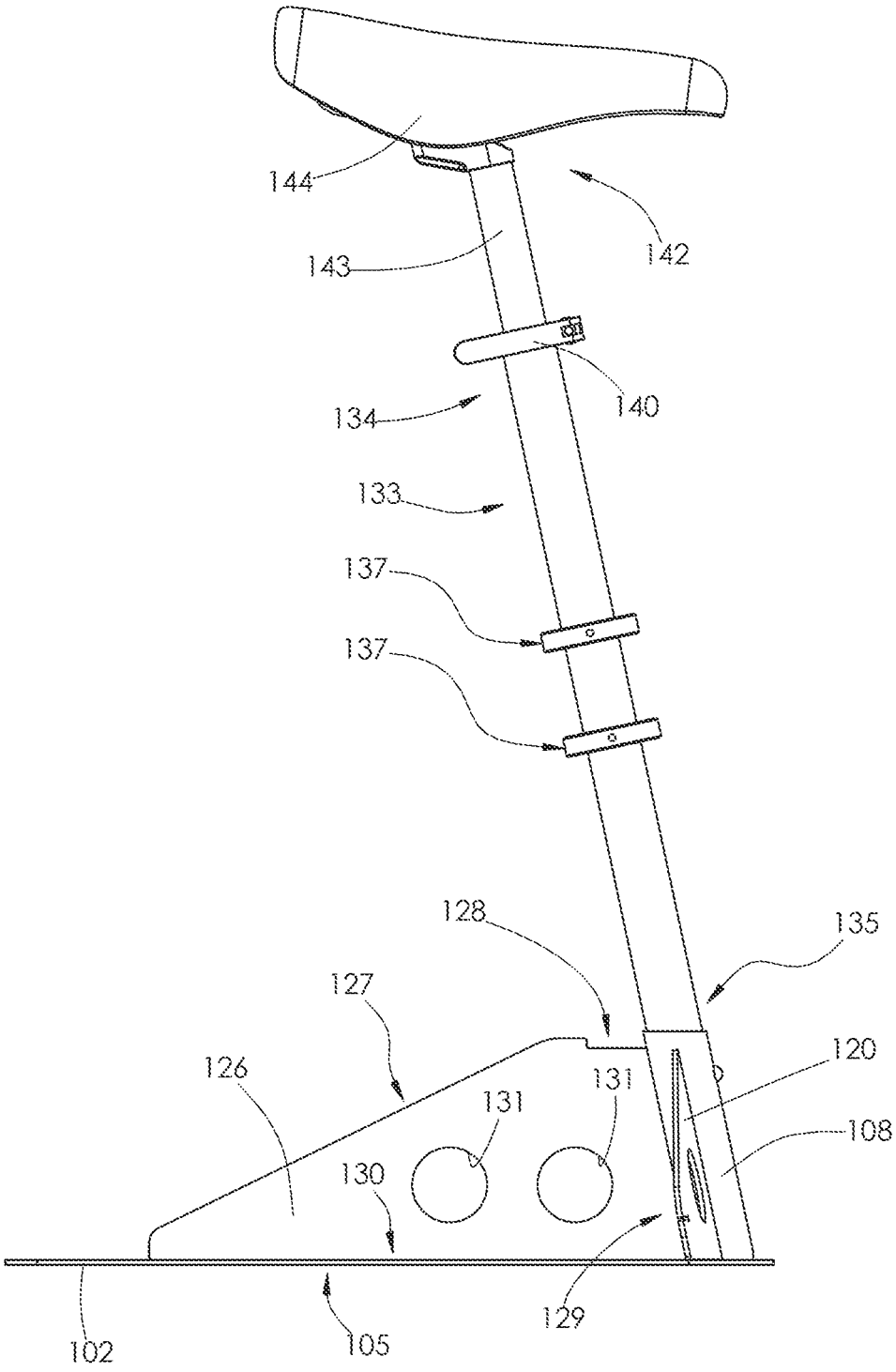
FIG. 3 is a side view of an embodiment retrofittable seat assembly.
Figure 4:
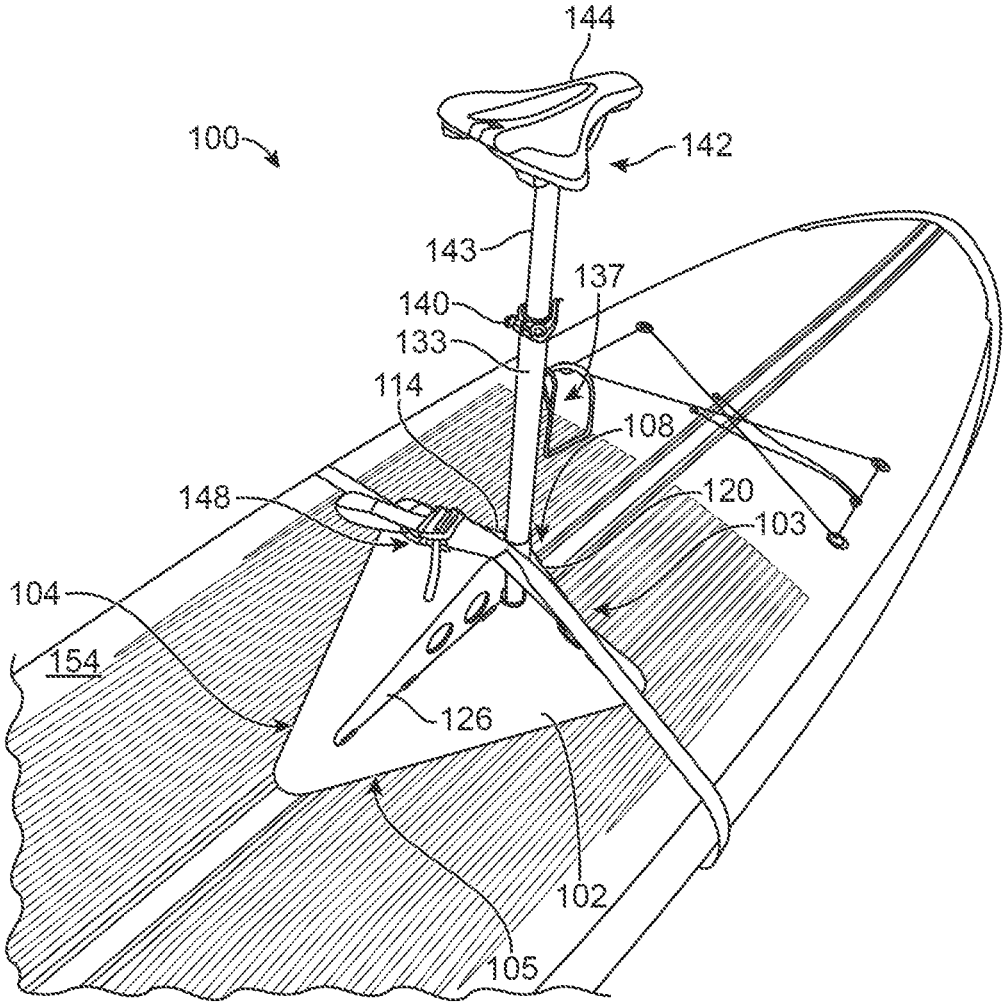
FIG. 4 is a rear perspective view of an embodiment retrofittable seat assembly.
Figure 5:
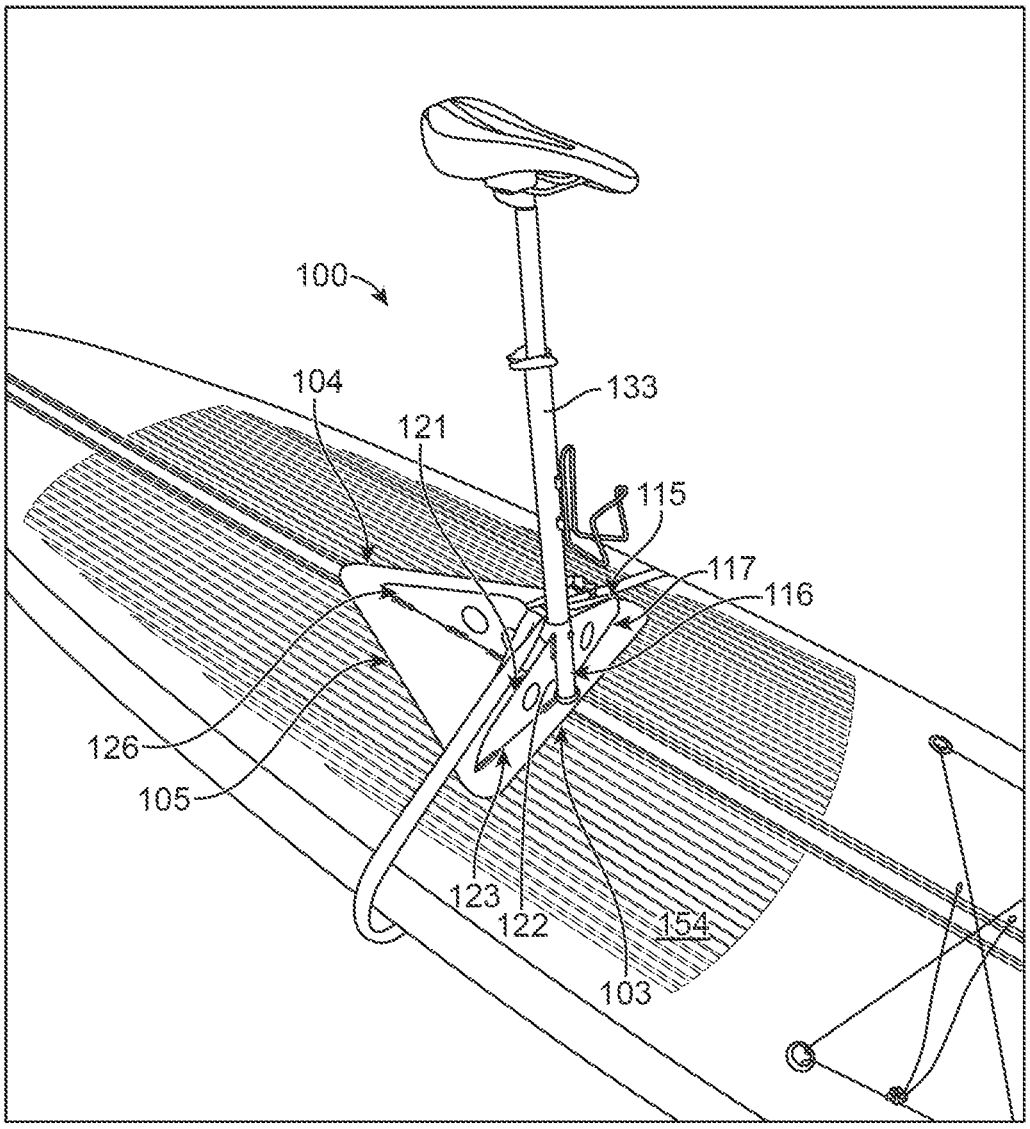
FIG. 5 is a front perspective view of the retrofittable seat assembly shown in FIG. 4.

One embodiment, shown in FIGS. 3-5, is a retrofittable seat assembly 100 including a base 102, a receiving post 133, a seat assembly 142, and a connecting member 148. The base 102 is a shape that provides stability and reduces a risk of tipping. For example, the base 102 could be a triangular plate member having a front 103, a first side 104, and a second side 105. The dimensions of the base 102 could depend upon what type of seat(s) and/or support structure(s) are being used with the assembly. If the assembly 100 is being used with a paddle board, for example, the front 103 could be 1 to 36 inches in length and the first and second sides 104 and 105 could be 4 to 48 inches in length. There could also be radii of approximately 2 inches proximate the junctures of the sides and/or the front. The base 102 could be 1/16 to 1/2 inch thick.

A base receiver 108 extends upward from the base 102. The base receiver 108 is configured and arranged to receive a mounting post of a seat. For example, the base receiver 108 could be a tubular member having a top 109, a bottom 110, and a bore 111 extending therethrough with the bottom 110 connected to the base 102. The bottom 110 could be connected to the base 102 via welding. Preferably, the base receiver 108 extends upward from proximate the front 103 of the base 102 at an angle of approximately 45 to 90 degrees relative to the base 102.

In one embodiment, there is at least one support interconnecting the base 102 and the base receiver 108 to add strength to the connection. A rear support 126 could extend from the base receiver 108 proximate the front 103 of the base 102 to the back of the base 102 between the sides 104 and 105. The rear support 126 could be generally triangular including a top 127, a side 129, and a bottom 130. The side 129 is connected to the base receiver 108 and the bottom 130 is connected to the base 102. Welding could be used to connect the support to the base 102 and the base receiver 108. The top 127 could include a void such as a notch 128, a slot 128', or the like configured and arranged to receive a portion of a connecting member. A notch 128 could be 1/16 to 2½ inches deep. A slot 128' (shown in FIG. 8) could be any suitable length and depth to accommodate any suitable connecting member. The bottom 130 could be approximately 1 to 36 inches in length. Optionally, the rear support 126 could include aperture(s) 131 to help reduce weight.

A first front support 114 could be used to interconnect the base 102 and the base receiver 108 to add strength to the connection, and it could extend from one side of the base receiver 108 to the first side 104 of the base 102. The first front support 114 could be generally triangular including a top 115, a side 116, and a bottom 117. The side 116 is connected to the base receiver 108 and the bottom 117 is connected to the base 102. Welding could be used to connect the support to the base 102 and the base receiver 108. Optionally, the first front support 114 could include aperture (s) to help reduce weight.

Similarly, a second front support 120 could be used to interconnect the base 102 and the base receiver 108 to add strength to the connection, and it could extend from one side of the base receiver 108 to the second side 105 of the base 102. The second front support 120 could be generally triangular including a top 121, a side 122, and a bottom 123. The side 122 is connected to the base receiver 108 and the bottom 123 is connected to the base 102. Welding could be used to connect the support to the base 102 and the base receiver 108. Optionally, the second front support 120 could include aperture(s) to help reduce weight.

In an embodiment, the base receiver 108 is configured and arranged to receive a receiving post 133, which is configured and arranged to receive the mounting post of a seat. The receiving post 133 is preferably generally tubular and includes a top 134, a bottom 135, and a bore 136 extending therethrough. The base receiver 108 and the receiving post 133 could be cylindrical, square, etc. The receiving post 133 could be 1 to 12 inch(es) tall and ⅜ to 2¾ inch(es) in diameter. Alternatively, the base receiver 108 and the receiving post 133 could be integral. The receiving post 133 could include at least one accessory mount 137 configured and arranged to receive at least one of a bottle holder, a rack, a hook, a connector, a pouch, and the like. For example, a water bottle, a flotation device, a towel, and the like could be connected to the seat assembly. Proximate the top 134 of the receiving post 133 is a quick-release connector 140 allowing for height adjustment of the mounting post of the seat.

Embodiments could be made of metal, plastic, composite materials, or any other suitable material. In one embodiment, the base is made of a light-weight material such as aluminum, plastic, or a composite material.

Any suitable seat assembly could be used. One example is a seat assembly 142 including a mounting post 143 and a seat 144. As shown in FIGS. 4 and 5, the seat 144 could be a bicycle seat and it is recognized that any other suitable type of seat could be used.

The connecting member 148, for connecting the base 102 to the support structure 154, could be an adhesive such as glue, double-sided tape, and the like or any suitable elongate member such as a strap with a ratchet mechanism, a belt with a buckle, a strap with hook and loop fastener, and the like. The elongate member could be a strap made of webbing. A fastener could be used with the elongate member such as a buckle, hook and loop fastener, and the like. Example buckles include, but are not limited to, ratchet buckles, side release buckles, double ring buckles, sliding bar buckles, and cam buckles.

Although shown connected to a stand-up paddle board as the support structure, the base 102 could be connected to any suitable support structure or the base 102 could even be used without the connecting member as a stool on the ground. For example, the user could detach the seat assembly on shore, place the base on the beach, grass, or other support structure, and sit while taking a break.

In addition, more than one seat assembly could be connected to the support structure. If more than one seat assembly is used, two or more users could paddle on different sides for a smoother ride.

When secured to a paddle board, the user may choose to not use the seat, lean against the seat, or sit on the seat. Also, a second user, such as a child, could sit on the seat while the first user stands. When sitting on the seat, the user may lean back without compromising stability/balance on the board. The assembly has many benefits including reducing stress on the user's feet, ankles, legs, and back thereby allowing the user to paddle more effectively and further while still getting exercise.

To install the retrofittable seat assembly 100 using an elongate member as the connecting member 148 on a support structure, such as a paddle board, the base 102 is preferably positioned approximately 3 to 5 inches behind where the user would position her or his feet when standing in the desired location. The elongate member is routed about the paddle board and the base, with a portion of the elongate member extending through the void 128, and the elongate member is tightened and secured onto itself. For example, a ratchet mechanism could be used. Installation is fast and easy, and disconnecting the seat assembly is similarly fast and easy.

Figure 6:
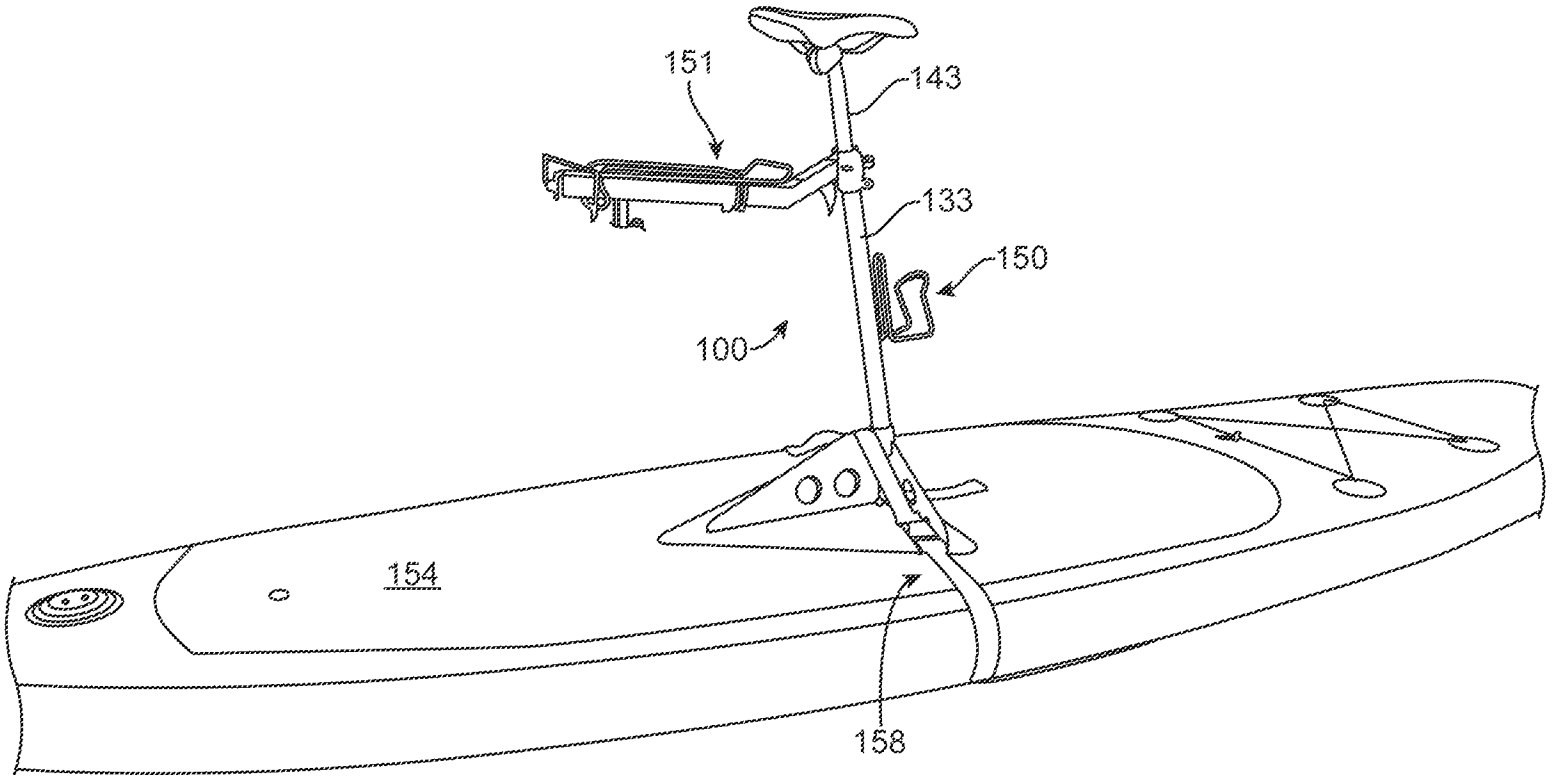
FIG. 6 is a side perspective view of an embodiment retrofittable seat assembly.
Figure 7:
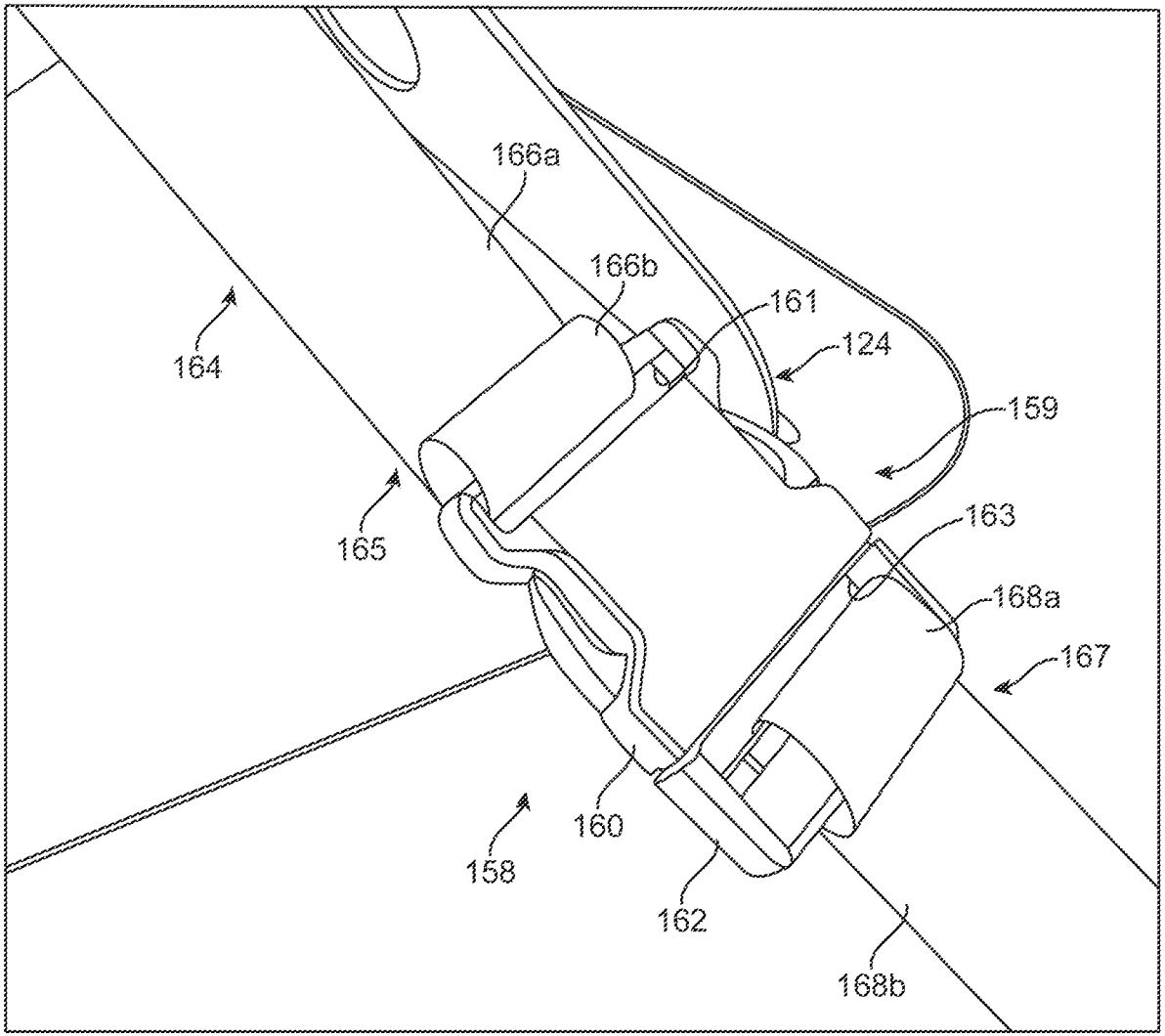
FIG. 7 is a top perspective view of a portion of a strap assembly of the retrofittable seat assembly shown in FIG. 6.

In one embodiment, shown in FIGS. 6 and 7, the connecting member is a side release buckle strap assembly including a side release buckle 159 and a strap 164. A first end 165 of the strap 164 is inserted through a slot 161 of a first buckle portion 160, and a second end 167 of the strap 164 is inserted through a slot 163 in a second buckle portion 162. One or both ends 165 and 167 of the strap include a fastener. For example, the first end 165 could include a fastener such as hook and loop fastener, and the hook portion **166*a* is connected to one side of the strap 164 and the loop portion 166*b* is connected to the other side of the strap 164 so that the first end 165 could be pulled taut through the slot 161 and secured onto itself using the fastener. Similarly, the second end 167 could include a fastener such as hook and loop fastener, and the hook portion 168*a* is connected to one side of the strap 164 and the loop portion 168*b* is connected to the other side of the strap 164 so that the second end 167 could be pulled taut through the slot 163** and secured onto itself using the fastener.

After the strap 164 is routed about the base 102 and the support structure 154, the first buckle portion 160 and the second buckle portion 162 are connected. One or both of the strap ends 165 and 167 are pulled so that the strap 164 is taut, and then the one or both strap ends 165 and 167 are secured onto themselves using the respective fasteners. As shown in FIG. 7, the distal ends could be rolled to interconnect the hook and loop fasteners, which acts as a strap keeper so that excess strap is not loose thereby reducing the risk of getting caught or creating trip hazards.

As shown in FIG. 6, embodiments could include a bottle holder 150, a rack 151, and other suitable types of accessories.

Figure 8:
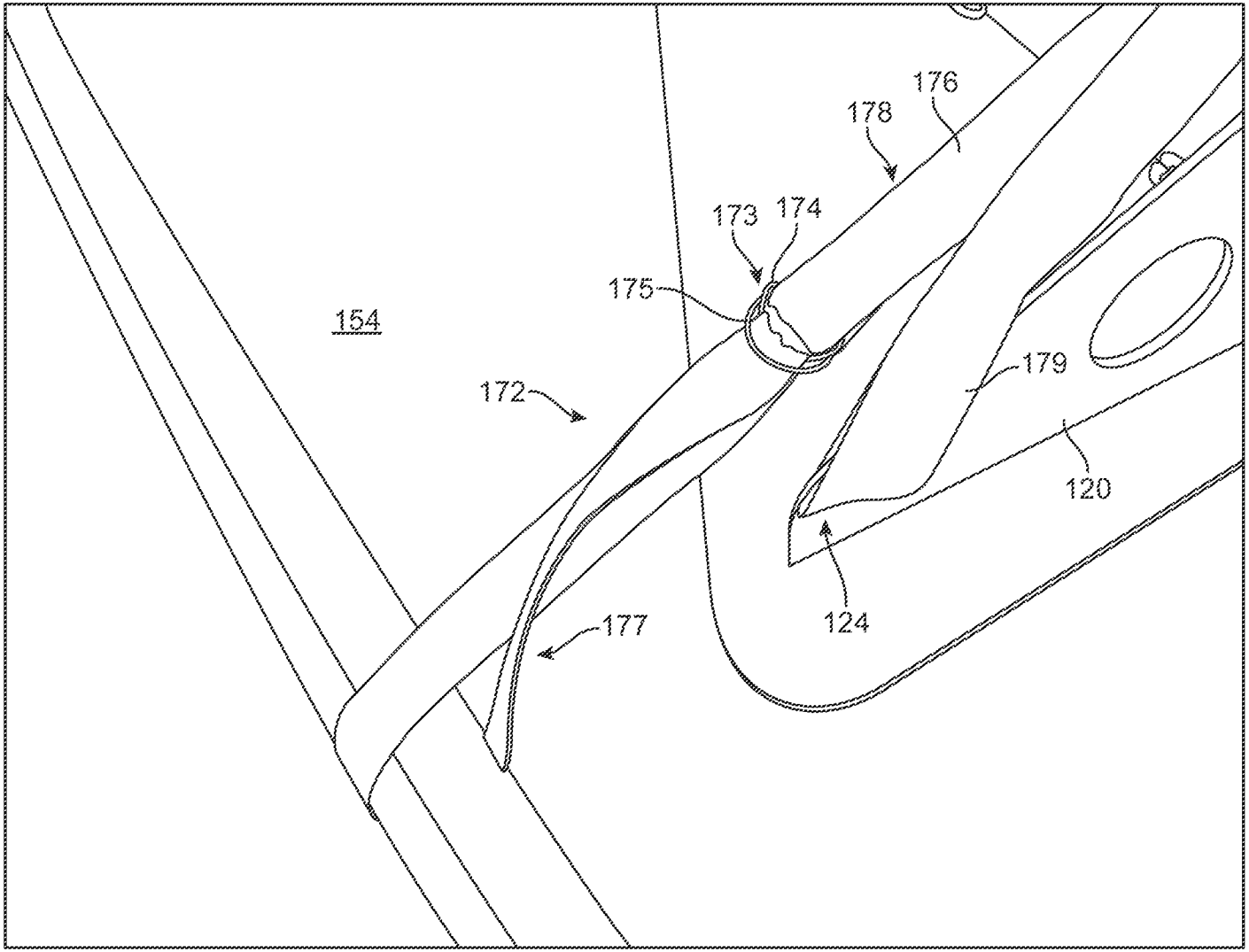
FIG. 8 is a top perspective view of a portion of another embodiment strap assembly for use with the retrofittable seat assembly shown in FIG. 6.
Figure 9:
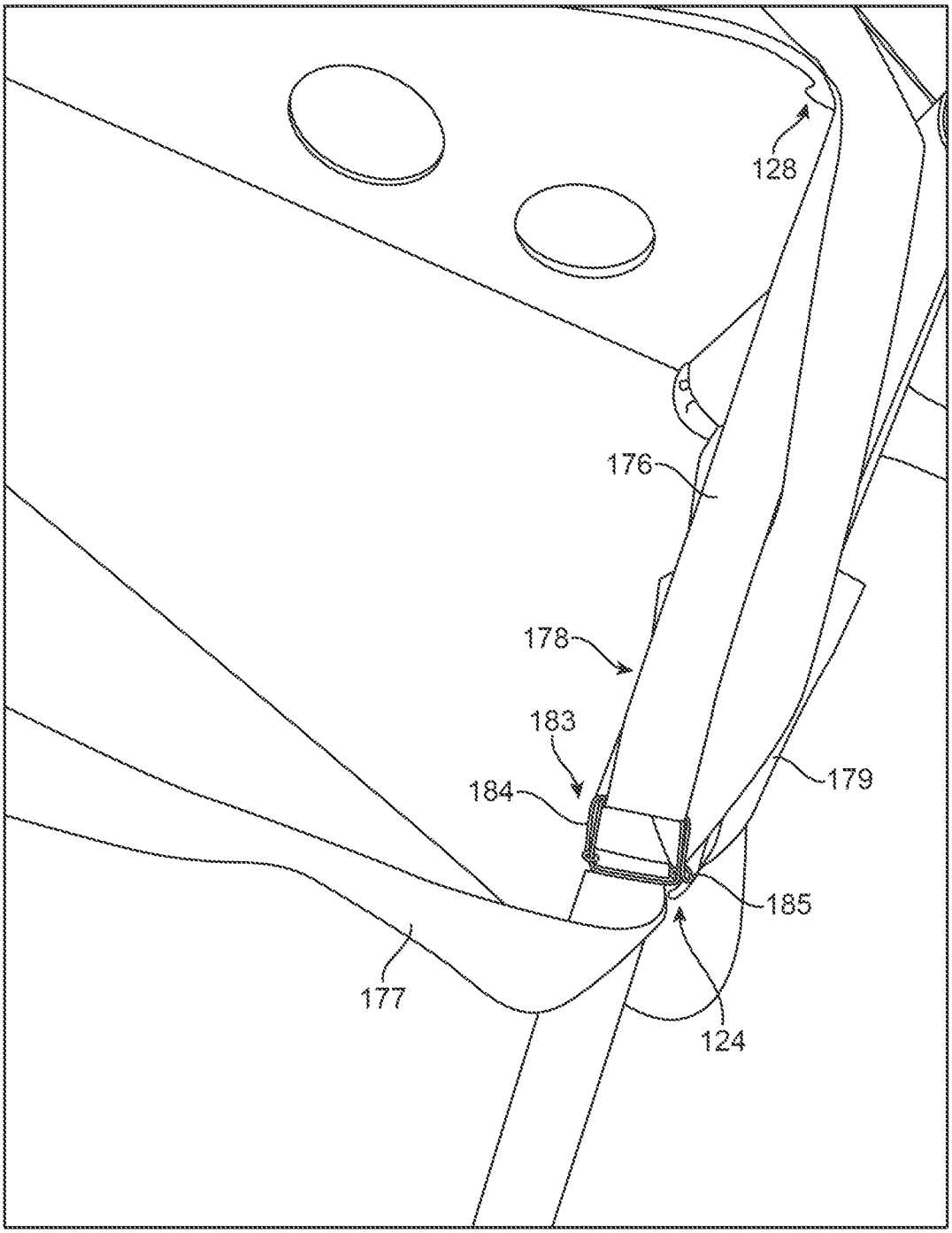
FIG. 9 is a top perspective view of a portion of another embodiment strap assembly for use with the retrofittable seat assembly shown in FIG. 6.

In one embodiment, either or both of the front supports 114 and 120 could include a slot 124, as shown in FIGS. 7-9. In FIG. 7, the slot 124 is not being used. In FIGS. 8 and 9, a strap includes a loop portion slid into the slot. Although the slot 124 is shown as an open slot, it could also be a closed slot so that the strap cannot be removed without altering the loop portion of the strap (e.g., changing the loop portion from an engaged position to a disengaged position).

In FIG. 8, a double ring buckle strap assembly 172 is used as the connecting member. The buckle 173 includes a first ring 174 and a second ring 175. The strap 176 includes a first end 177, and second end 178, and a loop portion 179. The second end 178 is connected to the buckle 173, and the loop portion 179 is connected to the strap proximate the second end 178. The loop portion 179 is inserted into the slot 124, the strap 176 is routed about the base 102 and the support structure 154, and the first end 177 is routed through the rings 174 and 175 to tightly secure the strap.

In FIG. 9, a strap assembly similar to that shown in FIG. 8 is used but buckle 183 replaces buckle 173. Buckle 183 includes a base 184 to which the second end 178 of the strap is connected, and the first end 177 is routed about a sliding bar 185 that slides relative to the base 184 to secure the strap.

Figure 10:
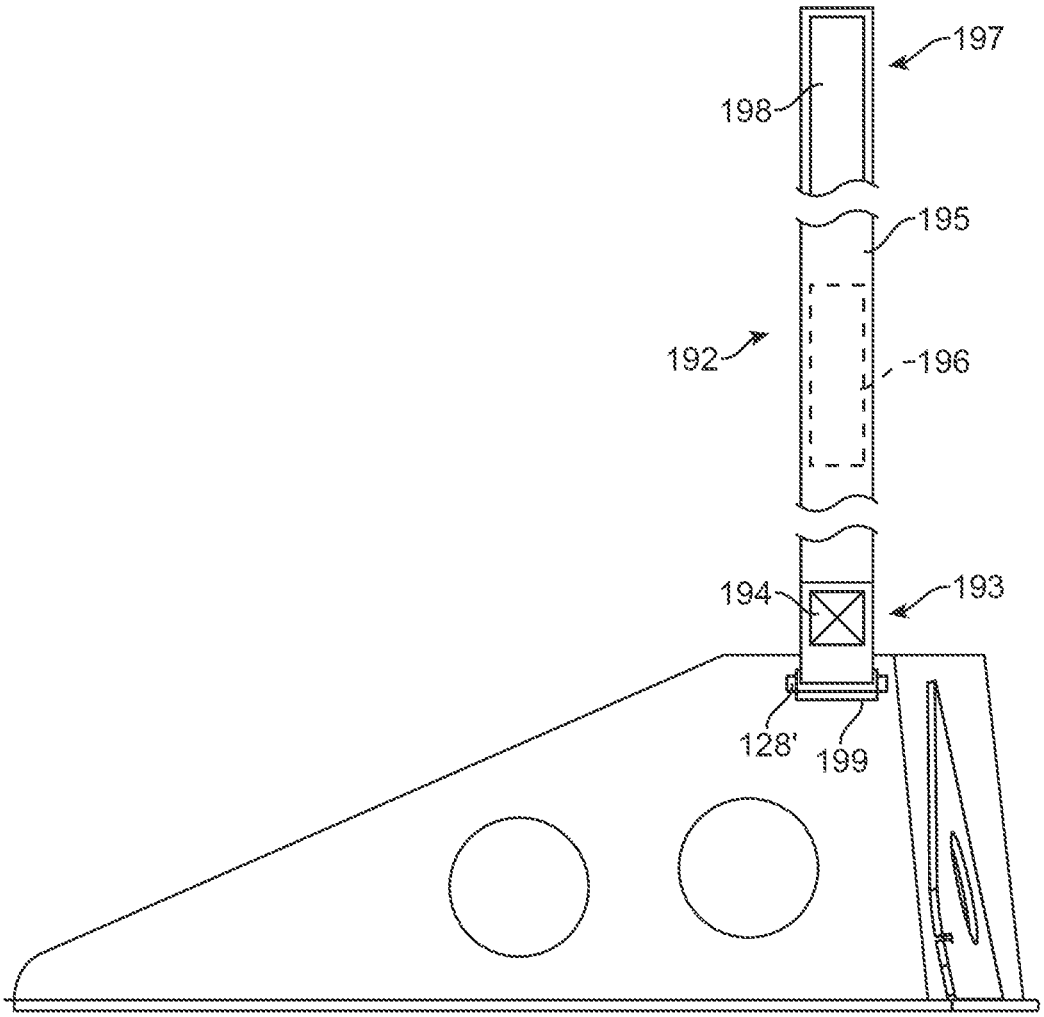
FIG. 10 is a side view of a base of an embodiment retrofittable seat assembly including a strap assembly in a disengaged position.
Figure 11:
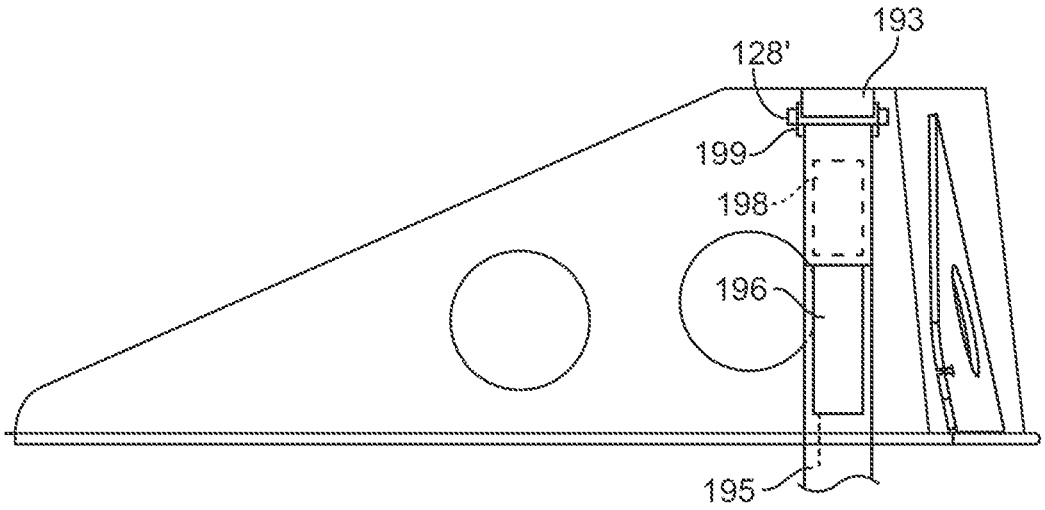
FIG. 11 is a side view of the base shown in FIG. 10 with the strap assembly in an engaged position.
Figure 12:
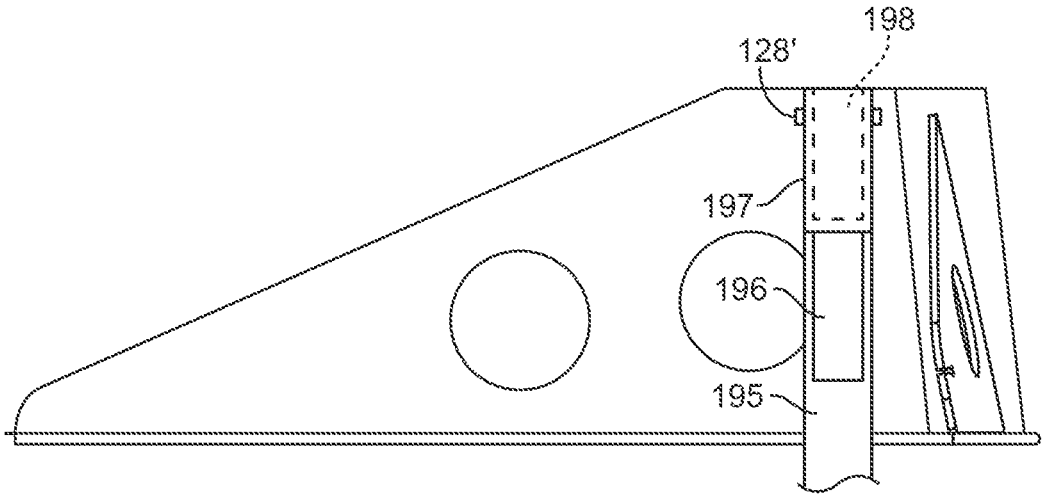
FIG. 12 is a side view of the base shown in FIG. 10 with the strap assembly in another embodiment engaged position.

In one embodiment, shown in FIGS. 10 and 11, an elongate member 192 includes a proximal end 193 inserted through the slot 128' and secured onto itself. For example, stitching 194 or any other suitable fastener could be used. A plastic or metal loop 199 could also be secured to the proximal end 193. An intermediate portion 195 of the elongate member 192 could be routed about the support structure and the base, and a distal end 197 of the elongate member 192 could be inserted through the loop 199, pulled tight, and secured onto the intermediate portion 195 with a fastener such as hook and loop fastener 196 and 198 or the like. Alternatively, as shown in FIG. 12, the loop 199 could be eliminated and the distal end 197 could be secured to the intermediate portion 195 with a fastener.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A retrofittable seat assembly, comprising:

a base, the base being a triangular plate member having a top, a bottom, a front, a first side, and a second side, the bottom of the base being configured and arranged to be positioned on a support structure;

a base receiver operatively connected to the top of the base proximate the front and configured and arranged to receive a mounting post of a seat;

a first support interconnecting the top of the base and the base receiver extending from the base receiver toward the first side;

a second support interconnecting the top of the base and the base receiver extending from the base receiver toward the second side;

a third support interconnecting the top of the base and the base receiver extending from the base receiver toward a juncture of the first and second sides; and a connecting member configured and arranged to connect the base to the support structure.

2. The retrofittable seat assembly of claim 1, wherein the base receiver extends upward at an angle of approximately 45 to 90 degrees relative to the base.

3. The retrofittable seat assembly of claim 1, wherein the base receiver includes a receiving post with a quick-release connector configured and arranged to adjust a height of the mounting post of the seat.

4. The retrofittable seat assembly of claim 1, wherein the base receiver includes a receiving post with an accessory mount configured and arranged to receive at least one of a bottle holder, a rack, a hook, and a connector.

5. The retrofittable seat assembly of claim 1, wherein the third support includes a void configured and arranged to receive a portion of the connecting member.

6. The retrofittable seat assembly of claim 5, wherein the void is selected from the group consisting of a notch and a slot.

7. The retrofittable seat assembly of claim 1, wherein the connecting member is a member selected from the group consisting of a ratchet strap, a belt with a buckle, a strap with hook and loop fastener, and an adhesive.

8. The retrofittable seat assembly of claim 1, wherein the base and the receiver are made of aluminum.

9. A retrofittable seat assembly, comprising:

a base, the base being a triangular plate member having a top, a bottom, a front, a first side, and a second side, the bottom of the base being configured and arranged to be positioned on a support structure;

a connecting member configured and arranged to connect the base to the support structure;

a base receiver operatively connected to the top of the base proximate the front and configured and arranged to receive a mounting post of a seat, wherein the base receiver extends upward from the top of the base at an angle to position the seat proximate a middle of the base; and at least one support interconnecting the top of the base and the base receiver, the at least one support includes a void configured and arranged to receive a portion of the connecting member.

10. The retrofittable seat assembly of claim 9, wherein the base receiver includes a receiving post with a quick-release connector configured and arranged to adjust a height of the mounting post of the seat.

11. The retrofittable seat assembly of claim 9, wherein the base receiver includes a receiving post with an accessory mount configured and arranged to receive at least one of a bottle holder, a rack, a hook, and a connector.

12. The retrofittable seat assembly of claim 9, wherein the void is selected from the group consisting of a notch and a slot.

13. The retrofittable seat assembly of claim 9, wherein the connecting member is a member selected from the group consisting of a ratchet strap, a belt with a buckle, and a strap with hook and loop fastener.

14. The retrofittable seat assembly of claim 9, wherein the base and the receiver are made of aluminum.

15. A retrofittable seat assembly, comprising:

a base, the base being a triangular plate member having a top, a bottom, a front, a first side, and a second side, the bottom of the base configured and arranged to be positioned on a support structure;

a base receiver operatively connected to the top of the base proximate the front and configured and arranged to receive a mounting post of a seat, wherein the base receiver extends upward from the top of the base at an angle to position the seat proximate a middle of the base;

a first support interconnecting the top of the base and the base receiver extending from the base receiver toward the first side;

a second support interconnecting the top of the base and the base receiver extending from the base receiver toward the second side;

a third support interconnecting the top of the base and the base receiver extending from the base receiver toward a juncture of the first and second sides, the third support including a void configured and arranged to receive a portion of a connecting member; and the connecting member configured and arranged to connect the base to the support structure.

16. The retrofittable seat assembly of claim 15, wherein the base receiver includes a receiving post with a quick-release connector configured and arranged to adjust a height of the mounting post of the seat.

17. The retrofittable seat assembly of claim 15, wherein the void is selected from the group consisting of a notch and a slot.

18. The retrofittable seat assembly of claim 15, wherein the connecting member is a member selected from the group consisting of a ratchet strap, a belt with a buckle, and a strap with hook and loop fastener.

19. The retrofittable seat assembly of claim 15, wherein the base and the receiver are made of aluminum.

20. The retrofittable seat assembly of claim 1, wherein the first, second, and third supports directly secure the base to the base receiver.

* * * * *